United States Patent [19]

Brooks

[11] 4,381,685

[45] May 3, 1983

[54] PIPE JOINT MAKE-UP AND BREAK-OUT TOOL

[76] Inventor: Marvin Q. Brooks, Box 179, Chickasha, Okla. 73018

[21] Appl. No.: 352,996

[22] Filed: Feb. 26, 1982

Related U.S. Application Data

[63] Continuation-in-part of Ser. No. 170,749, Jul. 21, 1980, abandoned.

[51] Int. Cl.[3] ..... B25B 17/00

[52] U.S. Cl. ..... 81/57.2; 81/57.13; 81/57.29

[58] Field of Search ..... 81/57.13, 57.14, 57.15, 81/57.2, 57.33, 57.29

[56] References Cited

U.S. PATENT DOCUMENTS

| | | | |
|---|---|---|---|
| 1,050,533 | 1/1913 | Hall . | |
| 2,523,193 | 9/1950 | Carson | 255/35 |
| 2,552,521 | 5/1951 | Coshow | 81/53 |
| 2,645,460 | 7/1953 | Lundeen | 255/35 |
| 3,330,552 | 7/1967 | Bucher | 269/55 |
| 3,387,512 | 6/1968 | Campbell | 81/54 |
| 3,668,949 | 6/1972 | Walker | 81/57.13 |
| 3,774,481 | 11/1973 | Goodman | 81/57.13 |
| 4,178,817 | 12/1979 | Gibson | 81/57.13 |

FOREIGN PATENT DOCUMENTS

| | | | |
|---|---|---|---|
| 554830 | 12/1977 | U.S.S.R. | 81/57.33 |
| 677905 | 8/1979 | U.S.S.R. | 81/57.13 |

*Primary Examiner*—James L. Jones, Jr.
*Attorney, Agent, or Firm*—Richards, Harris & Medlock

[57] ABSTRACT

A tool (10) for rotating a length of pipe (72) to make or break a pipe joint is provided. A frame (12) supports the tool (10) on a surface. A carrying handle (30) is attached to the frame (12) for moving to and from the site where it is to be used. A motor (28) is attached to the frame (12) and drives a rotating drum (32) which is rotatably secured in the frame (12). The rotating drum (32) is driven by the motor (28) through a gear train (34 and 36). The rotating drum (32) has a serrated surface (38) for engaging and spinning the pipe (72). A C-shaped pipe embracing means (40) is pivotally attached to the frame (12) with pivot pin (42). Idler rollers (44) are rotatably mounted in the C-shaped pipe embracing means (40) and clamp the pipe (72) firmly in contact with the serrated surface (38) of the rotating drum (32).

5 Claims, 5 Drawing Figures

PIPE JOINT MAKE-UP AND BREAK-OUT TOOL

This is a continuation-in-part of application Ser. No. 170,749, filed July 21, 1980, now abandoned.

TECHNICAL FIELD

This invention relates to tools, and more particularly to a pipe joint make-up and break-out tool for making or breaking threaded pipe joints.

DESCRIPTION OF THE PRIOR ART

In drilling oil, water, gas or other wells, long lengths of pipe are essential to the drilling and casing of the wall. Naturally, short lengths of pipe are threaded together at pipe joints to form the required length of pipe. Commonly, lengths of pipe have one end with male threads, with the other end having female threads. As the drilling of the well progresses, a new length of pipe is fitted into the preceding one to form a long drill string with many pipe joints. After the well has been drilled, some of the lengths of pipe used in the drilling operation must be withdrawn, such as those forming the drill string. This action requires unthreading the length of pipe at the surface of the well from the length immediately below it.

Different diameters of pipe are used in drilling a well. In an oil or gas well, for example, one diameter of pipe is used to attach a drill bit used to drill the wellbore. A second, larger diameter pipe is used as a well casing after the bore has been drilled.

Devices have been used to aid in making or breaking pipe joints. Some devices utilize spring or hand power to turn a toothed gear which engages and turns the pipe to make or break the pipe joint. These devices often use a pair of jaws to clamp the pipe into contact with the toothed gear, and do not readily accommodate different diameters of pipe. The prior devices are often hand held, light in weight, and unsuited for long lengths of pipe in heavy use.

A need thus exist for a tool which is powerful and strongly built, which will make and break pipe joints, and which will accommodate differing diameters of pipe.

DISCLOSURE OF THE INVENTION

A tool for spinning a length of pipe to make or break a pipe joint comprises a supporting frame with a carrying handle attached for moving the tool. A motor is secured to the frame, and drives a rotating drum which is mounted in the frame. The rotating drum has a serrated surface of turning the pipe to make or break a pipe joint. an arcuate or C-shaped pipe embracing member is pivotally attached to the frame on an axis which is laterally offset from the axis of rotation of the rotating drum. The pipe embracing member clamps the pipe in firm engagement with the serrated surface of the rotating drum.

BRIEF DESCRIPTION OF THE DRAWINGS

A more complete understanding of the invention and its advantages will be apparent from the following Detailed Description taken in conjunction with the accompanying drawings in which.

DETAILED DESCRIPTION

Figure 1:
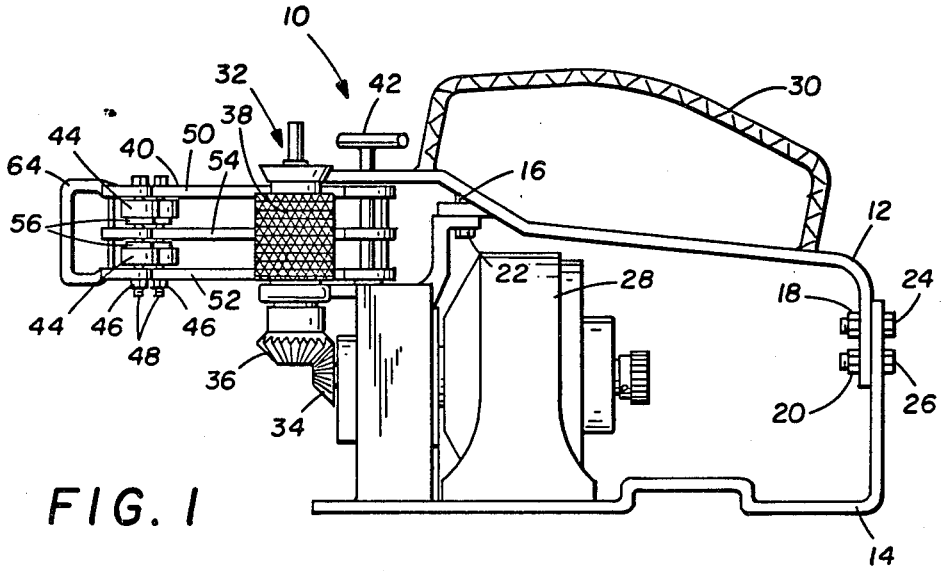
FIG. 1 is a side elevational view of a pipe joint make-up and break-out tool of the present invention.

FIG. 1 illustrates a pipe joint make-up and break-out tool and is generally identified by the numeral 10. Pipe tool 10 includes a frame 12 connected to a base 14 by nuts 16, 18, and 20 and bolts 22, 24, and 26. Base 14 rests upon the ground and supports the tool 10. A motor 28 is rigdly secured to frame 12. Motor 28 can be an electric motor, as in the preferred embodiment, or a small displacement gasoline engine. A handle 30 is attached to frame 12 for moving the pipe tool 10 to the site of operation.

A rotating drum 32 is mounted in frame 12 and driven by motor 28 through gears 34 an 36. Rotating drum 32 has a serrated surface 38 which can take the form of diamond-shaped indentations. The serrated surface 38 of drum 32 provides a frictional surface which engages the pipe to be spun. As will be recognized by those skilled in the art, a toothed gear can also function as a frictional engaging surface.

An arcuate, C-shaped pipe embracing member 40 is pivotally attached to frame 12 by removable pivot pin 42. Pin 42 provides a pivot point or hinge point about which the pipe embracing member 40 pivots. As seen in FIG. 1, the pivot for pipe embracing member 40 is laterally offset from the axis of rotation of the rotating drum 32. The offset of the pivot allows the pipe spinning tool 10 to accommodate different diameters of pipe.

The pipe embracing member 40 contains two pairs of idler rollers 44. The idler rollers 44 engage the pipe when the pipe embracing member 40 clamps the pipe against the serrated surface 38 of the rotating drum 32. Each idleer roller 44 is held in pipe embracing member 40 between one of the end pieces 50 and 52 and the center ridge 54. Spacers 56 provide a gap between center ridge 54 and idler rollers 44.

Figure 2:
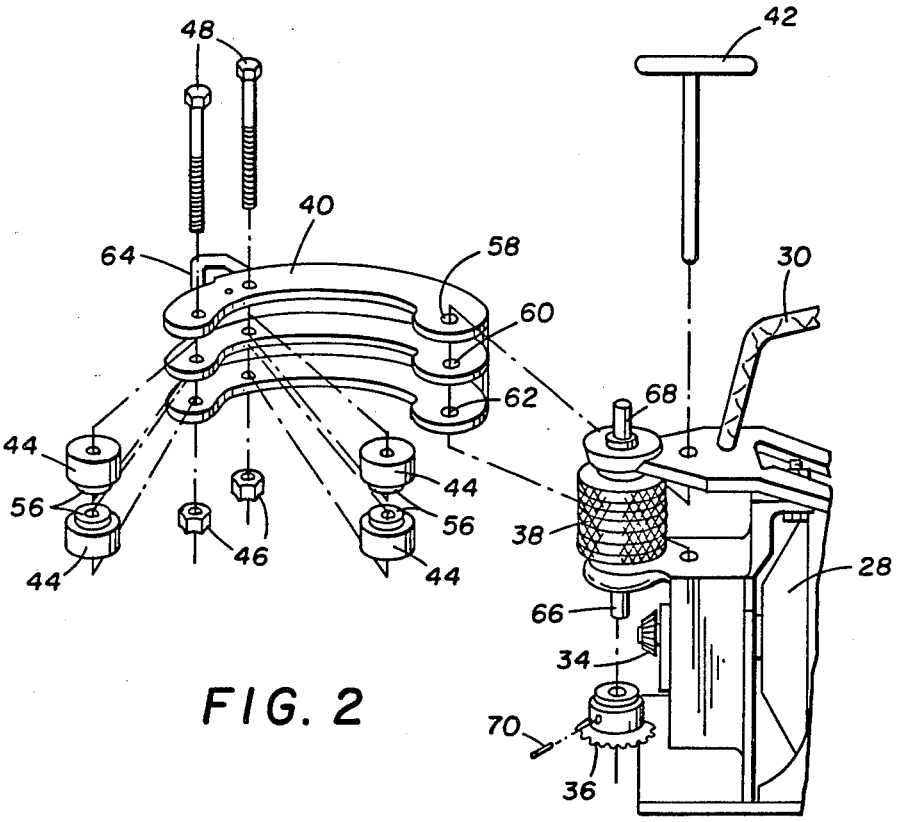
FIG. 2 is an exploded perspective view of a pipe joint make-up and break-out tool.

FIG. 2 illustrates the component parts of a pipe tool 10. The removable pivot pin 42 passes through apertures 58, 60 and 62 in the pipe embracing member 40. Bolts pass through apertures in pipe engaging member 40 to secure idler rollers 44 and spacers 56 therein. Nuts 46 secure bolts 48 in the pipe embracing member 40. As will be more fully described hereinbelow, a handle 64 is attached to the outer periphery of pipe embracing member 40 near the position of the idler rollers 44.

Shafts 66 and 68 of rotating drum 32 secure rotating drum 32 in frame 12. As illustrated in the FIGURES, frame 12 is bolted to base 14 so that rotating drum 32 is removably secured therein. Those skilled in the art will recognize that frame 12 could be permanently secured to base 14, in which case drum 32 would not be removable.

Motor 28 attached to frame 12 has a drive shaft to which gear 34 is attached. Gear 34 engages gear 36 attached to shaft 66 of rotating drum 32. A screw 70 secures gear 36 to shaft 66. A smiliar screw, not shown, attaches gear 34 to the drive shaft of motor 28.

Figure 3:
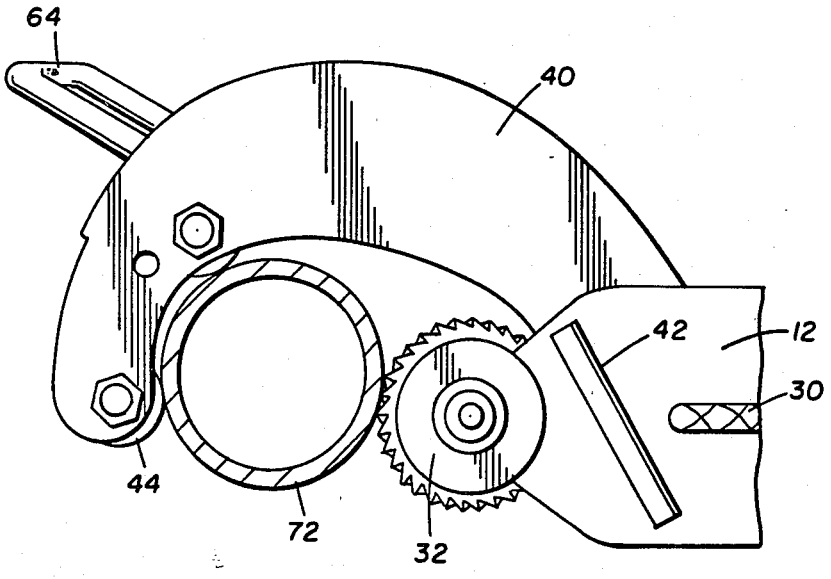
FIG. 3 is a plan view of the tool making or breaking a pipe joint.
Figure 4:
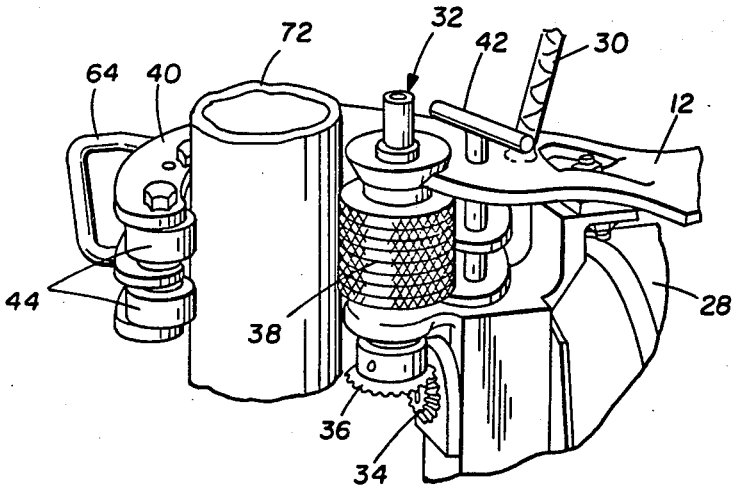
FIG. 4 is a side elevational view of the tool making or breaking a pipe joint in a first position.

FIGS. 3 and 4 illustrate the pipe tool 10 making or breaking a joint in a pipe 72. Pipe 72 is placed within the reach of pipe embracing member 40. The pipe embracing member 40 is pivoted about pivot pin 42 until pipe 72 is firmly clamped between the idler rollers 44 and the serrrated surface 38 of rotating drum 32. Handle 64 provides a ready means for a person to transmit clamping forces to pipe 72. Motor 28 rotates drum 32 to spin pipe 72, thereby making or breaking the pipe joint.

As can be seen more clearly in FIG. 4, pipe 72 is in direct contact with the diamond studded serrated surface 38 of rotating drum 32, and idler rollers 44.

Figure 5:
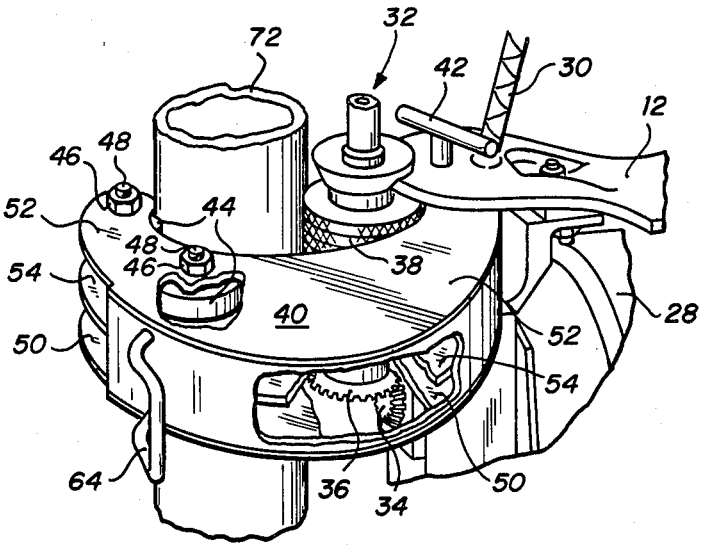
FIG. 5 is a side elevation view of the tool making or breaking a pipe joint illustrated in a second position.

Referring now to FIG. 5, pipe embracing member 40 is shown in the opposite reversed position from that illustrated in FIG. 4 to grasp pipe 72 from the opposite side as illustrated in FIG. 4. Pipe embracing member 40 is removable from the frame 12 by removing pivot pin 42. By reversing the position of pipe embracing member 40 to that shown in FIG. 5, and reinserting pivot pin 42 through apertures 58, 60 and 62 (FIG. 2) pipe embracing member 40 is then remounted to frame 12 for pivotal movement about pivot pin 42 in th opposite direction from that illustrated in FIG. 4. In this manner, pipe embracing member 40 can embrace pipe 72 from either direction for making or breaking the pipe joint.

Referring to FIGS. 1–5, the operation of pipe tool 10 is to be seen. The pipe 72 with the joint to be made or broken is placed within the jaw of the C-shaped pipe embracing member 40. Handle 64 is grasped and the pipe embracing member 40 rotated about pivot pin 42 to clamp pipe 72 between idler rollers 44 and rotating drum 32. When pipe 72 is firmly engaged wih rotating drum 32, motor 28 is activated and turns rotating drum 32. The firm contact between pipe 72 and rotating drum 32 rotates pipe 72 to make or break the pipe joint depending upon the position of pipe embracing member 40 as illustrated in FIGS. 4 and 5.

As is evident to those of skill in the art, the laterally offset pivot pin 42 permits pipe tool 10 to be used with different diameter pipes. A smaller diameter pipe 72 requires the pipe engaging member 40 to be swung more fully in a counterclockwise direction, as seen in FIG. 3, than in the case when pipe 72 is of larger diameter.

While only one embodiment of the present invention has been described in detail herein and shown in the accompanying drawings, it will be evident that various modifications are possible without departing from the spirit and scope of the invention.

I claim:

1. A pipe tool for making or breaking a pipe joint without latching of the tool around the pipe, which tool comprises:

a frame adapted to be positioned in proximity to the pipe, said frame including an aperture;

a rotating drum vertically mounted to said frame for engaging the pipe, said drum being mounted for rotation in first and second directions to thereby selectively rotate the pipe in first and second directions;

an arcuate pipe embracing member having first and second ends, said arcuate pipe embracing member being removably and reversibly pivotally mounted at said first end thereof to said frame for clamping the pipe aganist said rotating drum;

mounting means received by said frame aperture for mounting said arcuate pipe embracing member at said first end thereof to said frame, such that said arcuate pipe embracing member engages a first side of the pipe and pivots about said mounting means for rotating the pipe in a first direction while said drum rotates in said first direction;

said mounting means being removable to permit said arcuate pipe embracing member to be removed from said frame and reversed for mounting said first end thereof to said frame with said mounting means to allow said arcuate pipe embracing member to engage a second side of the pipe oppostie said first side of the pipe to thereby rotate the pipe in a second direction opposite said first direction while said drum rotates in said second direction;

first roller means mounted to said arcuate pipe embracing member second end for engaging the pipe at a position opposite said position of engagement with said drum; and second roller means mounted to said arcuate pipe embracing member between said first and second ends thereof to engage the pipe and eliminating the need for means to clamp the arcuate pipe embracing member to the frame to oppose pivotal movement of the arcuate pipe embracing member when said drum is rotated.

2. The pipetool of claim 1 wherein said pipe embracing member connects to said frame at a position offset from the axis of rotation of said drum whereby said pipe embracing member pivots to clamp different diameters of pipe into engagement with said drum.

3. The pipe tool of claim 1 and further including:

a motor mounted to said frame for driving said drum through a gear train to rotate the pipe, thereby making or breaking the pipe joint.

4. The pipe tool of claim 1 wherein said pipe embracing member is C-shaped.

5. The pipe tool of claim 1 wherein said drum includes a plurality of teeth on its surface for frictionally engaging the pipe.

* * * * *